United States Patent [19]

Murphy et al.

[11] Patent Number: 4,599,967

[45] Date of Patent: Jul. 15, 1986

[54] VESSEL NOZZLE CLEANING APPARATUS AND METHODS

[75] Inventors: Arthur D. Murphy, Macclesfield, England; Alan E. T. Grattidge, Aberdeen, Scotland

[73] Assignee: John M. Henderson and Company Limited, Aberdeen, Scotland

[21] Appl. No.: 670,317

[22] Filed: Nov. 13, 1984

[30] Foreign Application Priority Data

Nov. 22, 1983 [GB] United Kingdom ..... 8331152

[51] Int. Cl.[4] ..... B05C 11/00

[52] U.S. Cl. ..... 118/72; 118/308; 118/317; 118/323; 15/93 R; 29/81 R; 164/158

[58] Field of Search ..... 15/93 R; 29/81 R; 164/158; 118/72, 308, 317, 323

[56] References Cited

U.S. PATENT DOCUMENTS

| | | | |
|---|---|---|---|
| 1,165,962 | 12/1915 | Frink | 15/93 R |
| 1,614,928 | 1/1927 | Merian | 15/93 R |
| 2,892,444 | 6/1959 | Perkins | 118/317 |
| 3,605,157 | 9/1971 | Thompson et al. | 15/93 R |
| 4,085,894 | 4/1978 | Kubo et al. | 118/317 |
| 4,185,350 | 1/1980 | Fish | 15/93 R X |
| 4,446,813 | 5/1984 | Kinkopf et al. | 118/72 |

*Primary Examiner*—Shrive P. Beck

*Attorney, Agent, or Firm*—Kinney & Lange

[57] ABSTRACT

The invention provides an arrangement for cleaning or deskulling the downwardly protruding nozzle of a vacuum degassing vessel comprising a rotatable tool carrier capable of being positioned below the degassing vessel; one or more scraping tools mounted on the tool carrier; means for rotating the tool carrier; and means for lowering the vessel and/or raising the tool carrier so as to engage the nozzle with the tools.

9 Claims, 10 Drawing Figures

VESSEL NOZZLE CLEANING APPARATUS AND METHODS

The present invention relates to apparatus for and methods of cleaning and repairing vessel nozzles, particularly but not exclusively for cleaning or "deskulling" of the nozzle of a Steelworks Vacuum Degassing Vessel after it has been dipped into a ladle containing molten steel during a steel vacuum degassing process.

As presently known, a commercial form of vacuum degassing utilises a vessel having a sealable connection to evacuating means, and a nozzle downwardly extending from the base. In operation the vessel is positioned such that the nozzle of this vessel dips into molten steel contained in a ladle and mounted on a ladle car. The vacuum induced in the vessel raises the steel up into the vessel for processing and the vacuum degassing vessel is raised and lowered cyclically during this process of operation. At the end of the treatment the vacuum degassing vessel nozzle is lifted from the ladle and the ladle removed. The vessel nozzle which, in practice, is a steel tube refractory covered internally and externally, is left with an external coating or "skull" of molten slag and metal at an elevated temperature of approximately 1500° C. This gradually cools in the atmosphere.

It is desirable to clean this nozzle after every process operation otherwise the build up on it becomes too great to continue the operation further. There is difficulty in approaching the nozzle to clean it manually or to carry out any repair by spraying with refractory material (known as "gunning") because of its elevated temperature. In practice the vessel is normally allowed to cool to enable operators to approach and carry out these operations but this waiting time and the manual cleaning and gunning occupies so much time that the process becomes slow and the output from a vacuum degassing vessel is therefore limited.

An object of the present invention is to overcome or at least substantially reduce the above mentioned disadvantages.

According to one aspect of the present invention there is provided a method of cleaning a vessel nozzle comprising mounting one or more cleaning tools on a tool carrier and rotating the carrier relative to the nozzle as the nozzle and/or the carrier is moved for engagement of the nozzle with the tools.

Where the vessel is a vacuum degassing vessel having a downwardly protruding nozzle, the tools, which may be scraping or machining tools for removing slag, steel and refractory from the nozzle, may be mounted for rotation with the carrier about a vertical axis and below the vessel as the nozzle is lowered into engagement with the tools and/or as the carrier is raised towards the nozzle for engagement with the tools.

The tools to engage with the bottom of the nozzle may be mounted on a fixed tool holder which rotates with the carrier or may be set on a toolholder designed to traverse across the face of the stationary nozzle while the carrier is rotating.

According to another aspect of the present invention, there is provided appratus for cleaning or deskulling the downwardly protruding nozzle of a vacuum degassing vessel comprising a rotable tool carrier capable of being positioned below the degassing vessel; one or more scraping tools mounted on the tool carrier; means for rotating the tool carrier; and means for lowering the vessel and/or raising the tool carrier so as to engage the nozzle with the tools.

The tool carrier may be mounted vertically to clean a vertically mounted nozzle or may be inclined to clean an angular set nozzle of an R.H. vessel in which case means for raising and lowering the inclined tool carrier along the line of its axis may be provided.

Two tool carriers may be mounted on the car, one for cleaning a vertical nozzle and one for cleaning an inclined nozzle.

The tools may be single or multi-bladed.

The tool carrier may be disposed on a supporting car, which may be provided with wheels and may run on tracks extending below the degassing vessel. The tracks may be the same tracks as are used by the vehicle holding the steel containing ladle.

A locating pin moved by manual, electric hydraulic or pneumatic means may be provided to locate and align the car accurately at the nozzle when deskulling or gunning.

In one embodiment of the invention, in addition to the arrangement for cleaning the nozzle of the vessel, means may be provided for subsequently spraying or "gunning" refractory material on to the external surface including the bottom of the nozzle and/or the internal surface of the nozzle and/or part of the hearth within the vessel itself.

The external surface of the nozzle may be gunned by means of a heat-protected refractory spray device arranged to be rotated about the nozzle by manual or mechanical operation and to coat refractory material in layers on to the nozzle. The spray device may be arranged for variable alignment and orientation in operation whilst the degassing vessel is stationary or is moved vertically.

The internal surface of the nozzle may be gunned by means of a telescopic spray device arranged to be mechanically or manually raised and rotated. At the upper end of the telescopic device is a refractory spray nozzle which can therefore be raised or lowered inside the degassing vessel nozzle to spray the inside surface thereof and the lower part of the hearth of the vessel.

The spray device or devices may be mounted on the supporting car with the deskulling apparatus. The car may also carry motors for the spray device or devices and the deskulling apparatus and pneumatically transported refractory powder and water for the spray device or devices. The deskulling apparatus and the spray device or devices may be arranged in line along or across the car so that each may be located for operation below the degassing vessel nozzle in turn.

In order that the invention may be more readily understood one embodiment thereof will now be described by way of example with reference to the accompanying drawings in which.

Figure 1:
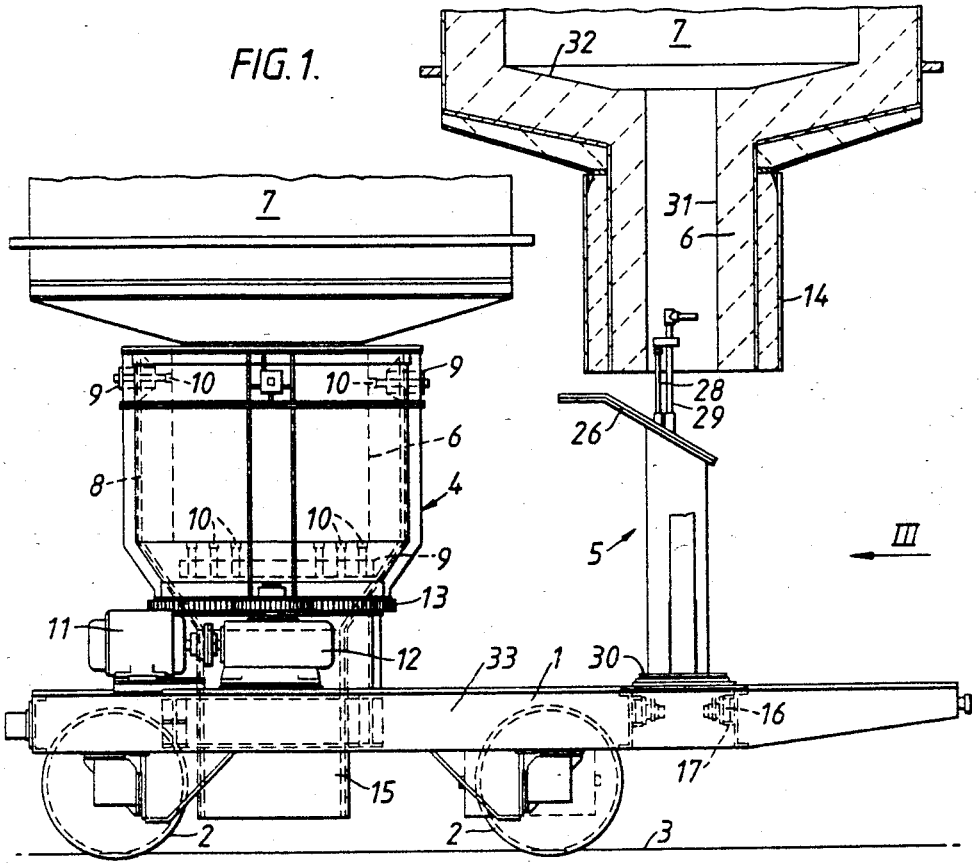
FIG. 1 is a side elevation of apparatus for deskulling and gunning the nozzle of a vacuum degassing vessel according to the invention.
Figure 2:
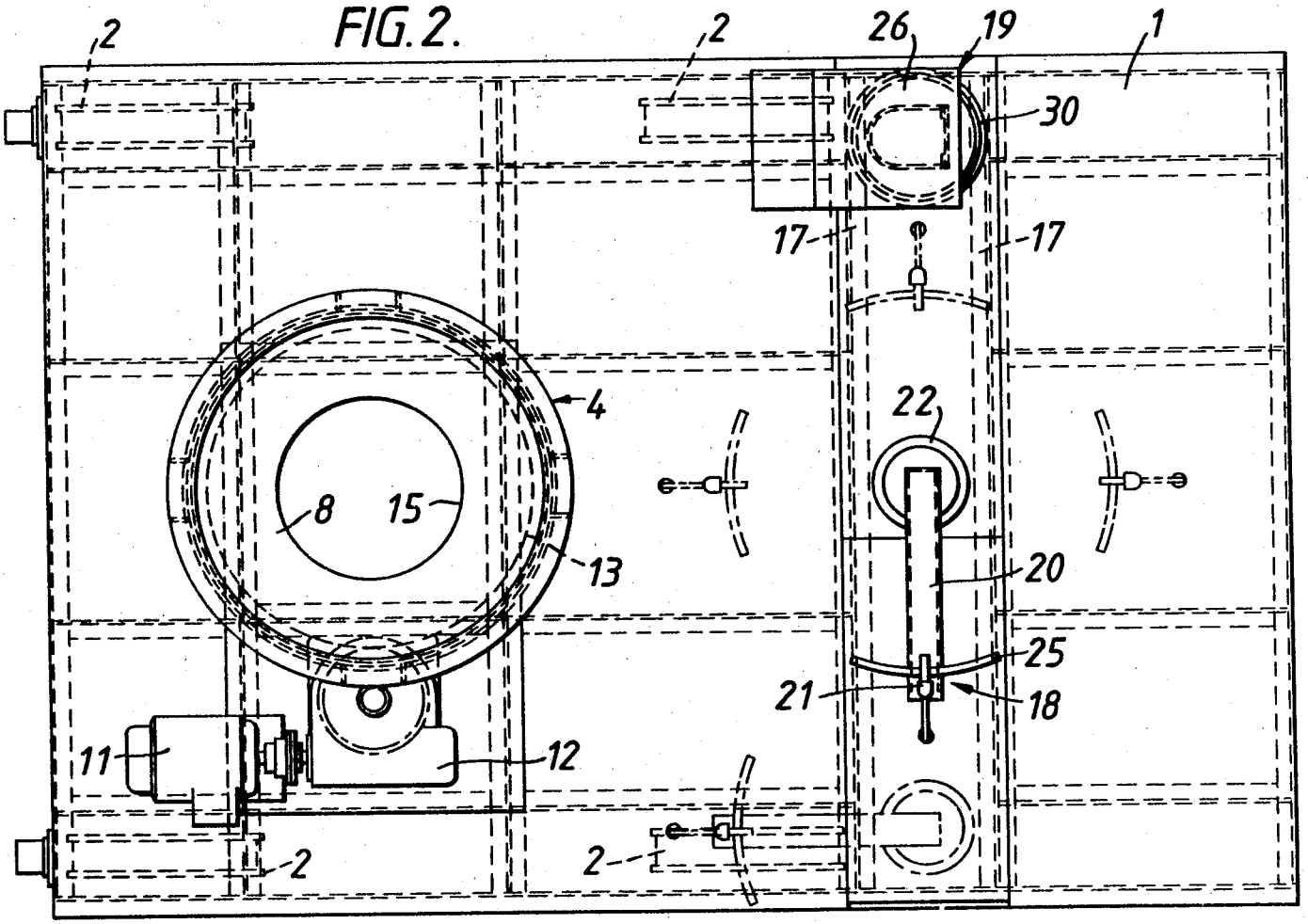
FIG. 2 is a plan view of the apparatus of FIG. 1.
Figure 3:
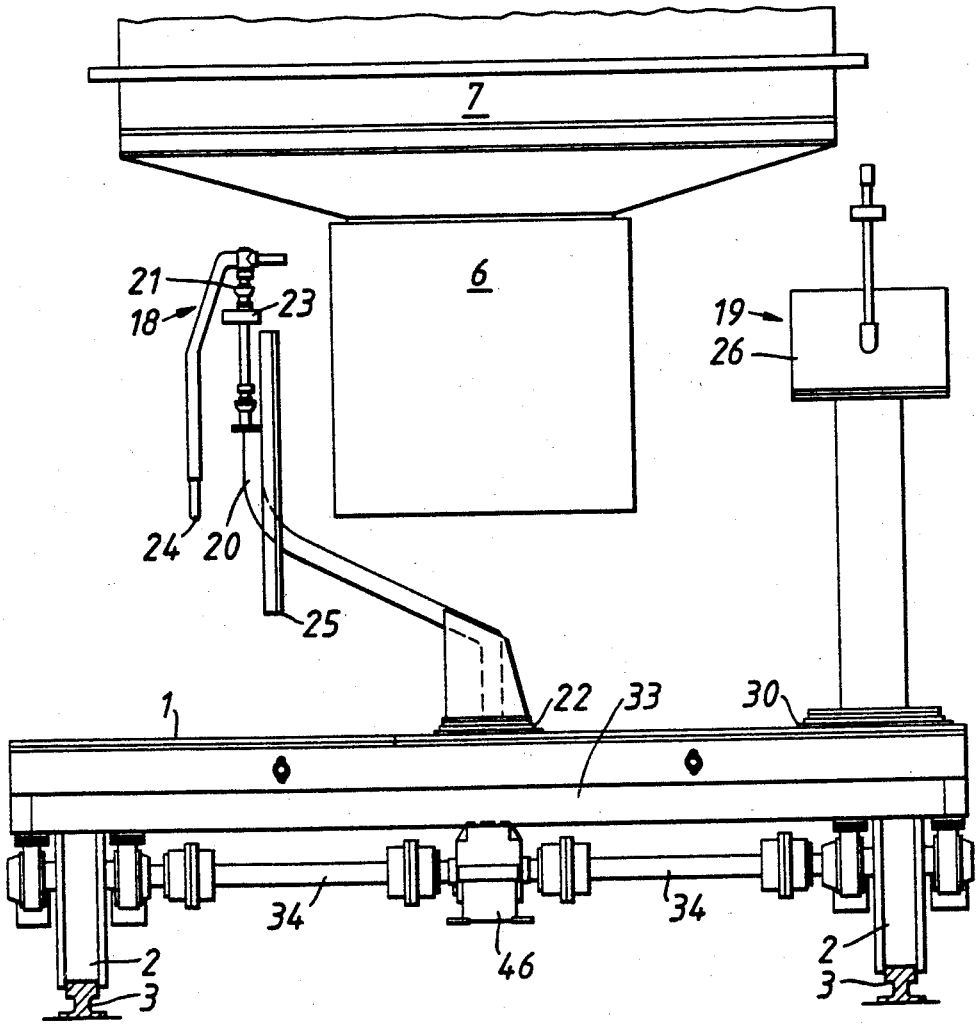
FIG. 3 is an end elevation in the direction of arrow III of the apparatus of FIG. 1.
Figure 4:
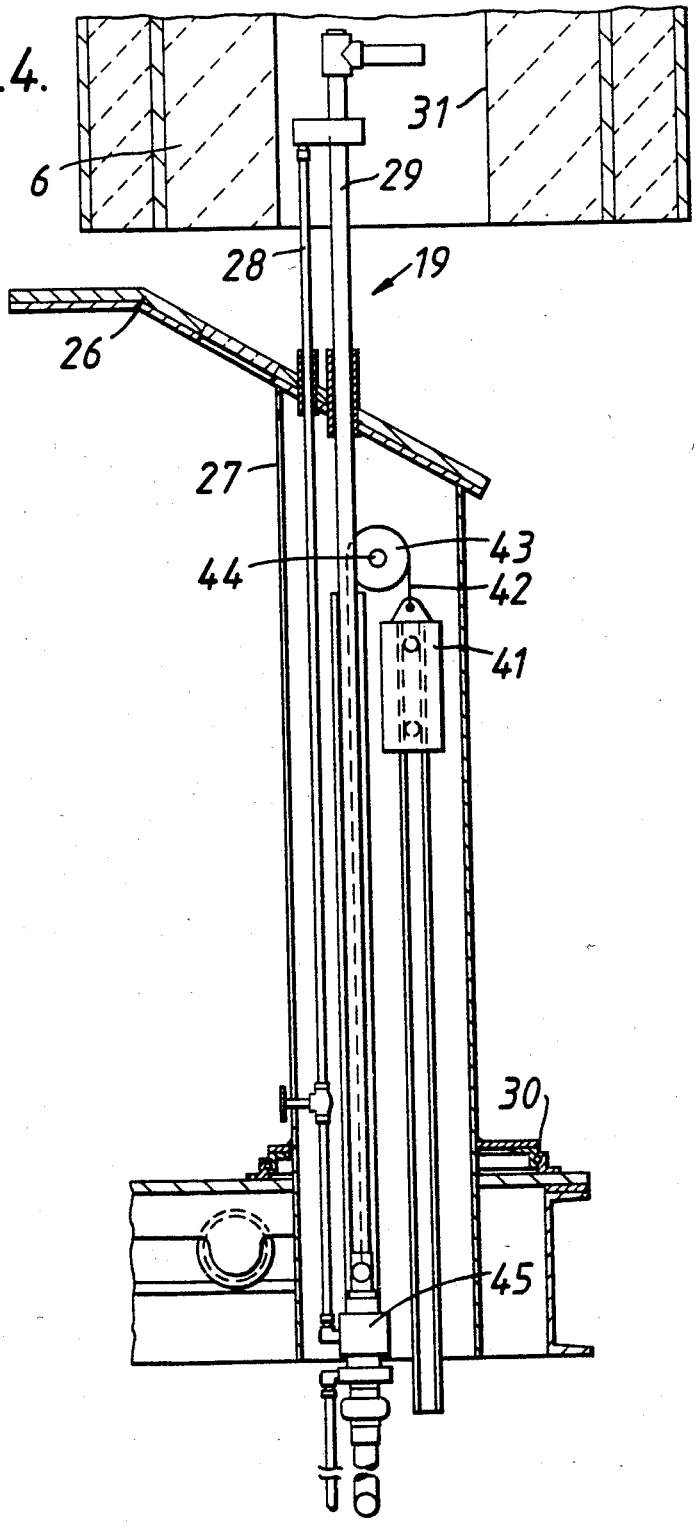
FIG. 4 is an enlarged part sectional elevation of part of FIG. 1.

Referring now to the drawings, and particularly to FIGS. 1, 2, 3 and 4 it will be seen that the apparatus comprises a support car 1 mounted on wheels 2 arranged to run on a track 3.

The car 1 carries deskulling apparatus 4 and gunning apparatus 5. In operation the car is arranged to move along track 3 so that the apparatus 4 and 5 are located below the nozzle 6 of a molten steel degassing vessel 7. In FIG. 1 the vessel is represented, to aid understanding, in each of its operational positions with respect to the apparatus 4 and apparatus 5.

The deskulling apparatus 4 consists of a refractory lined chamber 8 on which are mounted scraping tool holders 9 and tools 10 designed to fit around the nozzle 6 when it is lowered into the chamber. The chamber 8 and the tools 10 are rotated by means of an electric drive from a motor 11 through a gearbox 12 and spur ring 13 at a speed compatible with the tool rate required for the removal of slag/steel and a certain amount of the refractory material from the outer surface 14 of the nozzle. The nozzle is lowered into the deskulling apparatus while the tools are rotating and the excess material removed by the tools 10 drops inside the chamber 8 and out below the bottom of the apparatus through a refractory-lined chute 15. The removed material is collected in a pit (not shown) underneath the track 3 and removed later. The rate of descent of the degassing vessel and the rotational speed of the tools is controlled.

After the material has been removed the vessel 7 is lifted clear of the deskulling apparatus 4.

The car is then displaced sideways along the track 3 so that the nozzle 6 is then in alignment with the two parts or units 18 and 19 of the gunning apparatus 5. These are mounted on wheels 16 on a trackway 17 extending across the car 1 so the two parts can be adjusted manually and either may be engaged with the nozzle 6 as required.

The external gunning unit 18 consists of a rotating arm on which is mounted a refractory gun and water mixer 21. The arm is arranged with a bearing 22 mounted on to the car top through which pneumatically conveyed refractory material and water are piped up to the mixer 21 where a mixing chamber 23 is installed. The position of the gun is controlled by a handle 24 held by the operator who rotates the arm 20 round the vacuum degassing vessel nozzle while shielded behind a heat shield 25 mounted on this arm 20. Pneumatically conveyed refractory material and water are connected separately to the car by means of hose couplings (not shown) each time the machine is used. Alternatively they can be permanently connected to the car by means of a pipe conveyor.

The internal refractory sprayer unit 19 which is located on the same track as the external refractory sprayer 18 is a telescopic device and includes a canopy 26 mounted on the telescopic mast 27 under which the operator can stand and view the operation of gunning the internal surface of the nozzle through a viewing window. The telescope consists of a pneumatic pipe 29 and water pipe 28 mounted in bearings and held by counterweight 41 from chains 42 attached to the pipework. The counterweighted chain passes over chain wheels 43 mounted on a horizontal shaft 44, this horizontal shaft connecting to handles (not shown) which may be rotated to raise and lower the pipework accordingly and so position the nozzle in the correct position for spraying. The air and water is fed to the pipework through swivel couplings 45 and the whole unit is mounted on a rotary bearing 30 on the car so that it can be turned by the operator during the spraying operation.

The viewing window is protected from falling refractory material by air blast or other window clearing method.

The height to which this telescopic unit will rise allows for the complete spraying of the internal surface 31 of the nozzle and the bottom part 32 of the vacuum vessel hearth.

Water and pneumatically conveyed material are connected to the car each time this unit is put into operation or alternatively they can be provided through a pipe conveyor.

The car 1 consists of a chassis 33, axles 34 and wheels 2 mounted on the rail tracks 3 on which the ladle car will travel. One axle is driven through a gearbox 46 by an electric motor (not shown) to enable the car to move from centre to centre and also down the track 3 to enable the car access to the degassing vessel.

It is necessary to mount on the end of the vacuum degassing nozzle 6 a light steel nose cone 35 (see FIGS. 9 and 10) to break the slag lying on the top of the ladle 36 when it is first engaged with the degassing vessel. To enable this nose cone to be attached to the nozzle a structure 37 is provided on the end of the car 1 on to which this nose cone can be lifted by a separate crane 38 and placed in position ready for the nozzle to be lowered onto it and attached to the nozzle by means of wire ropes 39. This function is carried out at the end of the gunning operation before the next vacuum degassing cycle.

The operational steps of the apparatus are illustrated in FIGS. 5 to 10.

Figure 5:
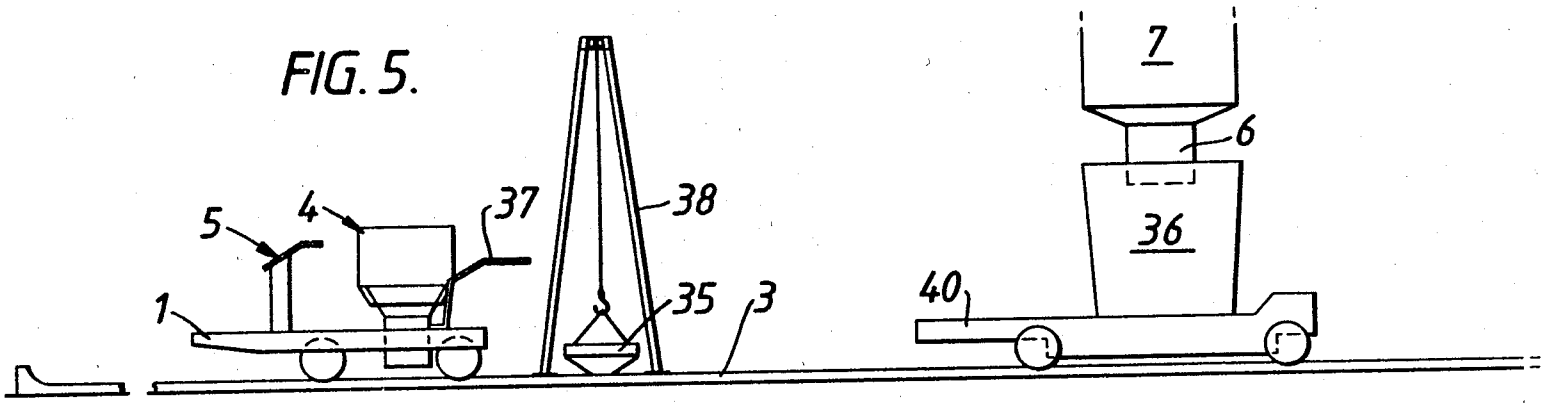
FIGS. 5 to 10 are schematic representations of the apparatus of FIG. 1 showing successive stages of operation.

FIG. 5 shows the car carrying the gunning apparatus 5 and deskulling apparatus 4 positioned adjacent to the cone 35 which is below a lifting beam or crane 38 while the ladle 36 on a car 40 is situated underneath the vacuum degassing vessel 7 in process of degassing the steel in the ladle.

Figure 6:
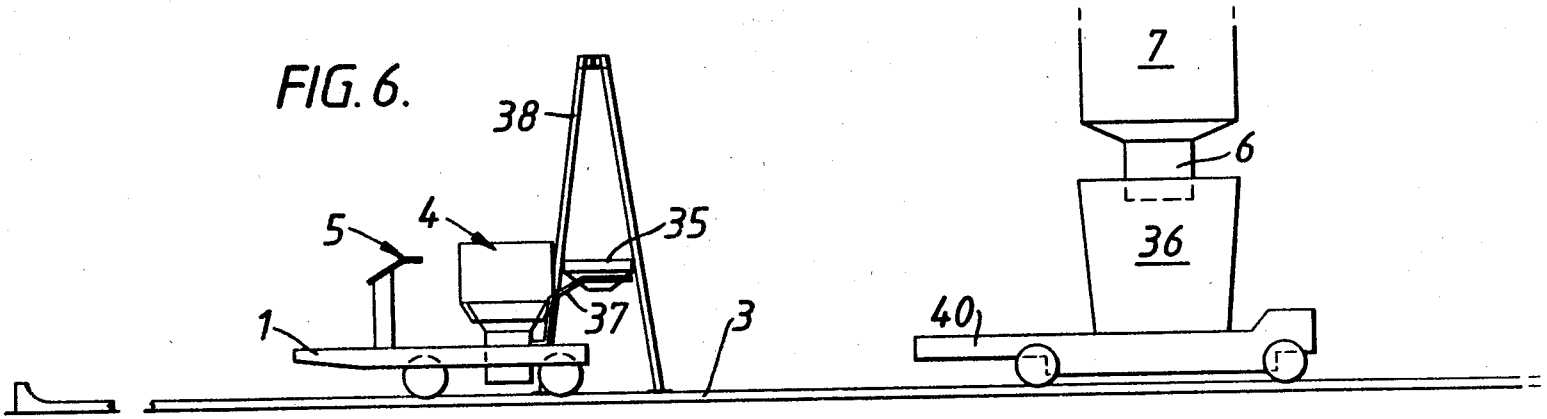

FIG. 6 shows the car 1 repositioned for the placement of the slag breaker cone 35 onto the holding frame 37.

Figure 7:
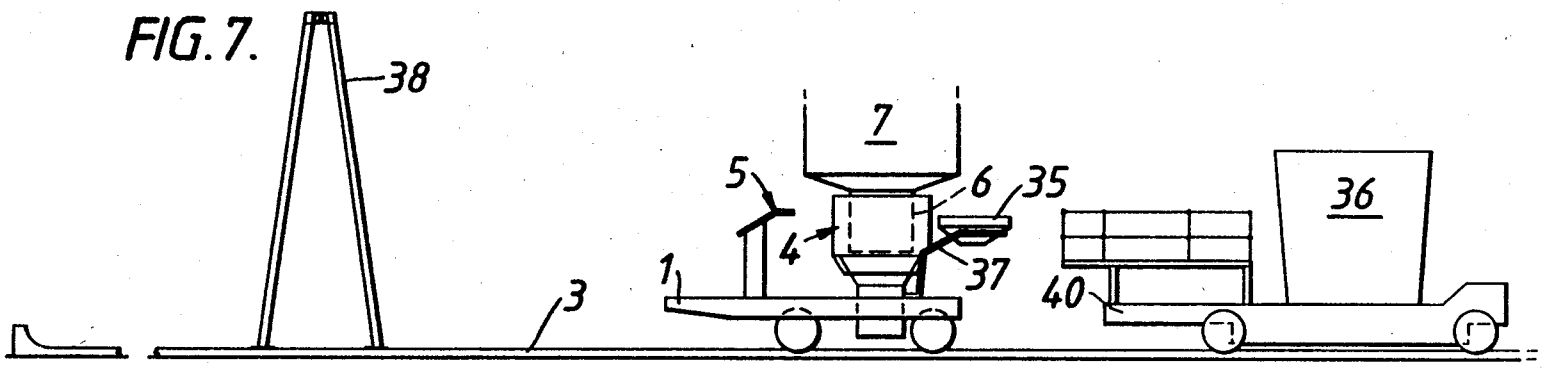

FIG. 7 shows the car 1 located in the nozzle deskulling position with the nozzle 6 fully lowered into the deskulling apparatus 4, the ladle car 40 having moved clear ready for the ladle 36 to be picked up by crane.

Figure 8:
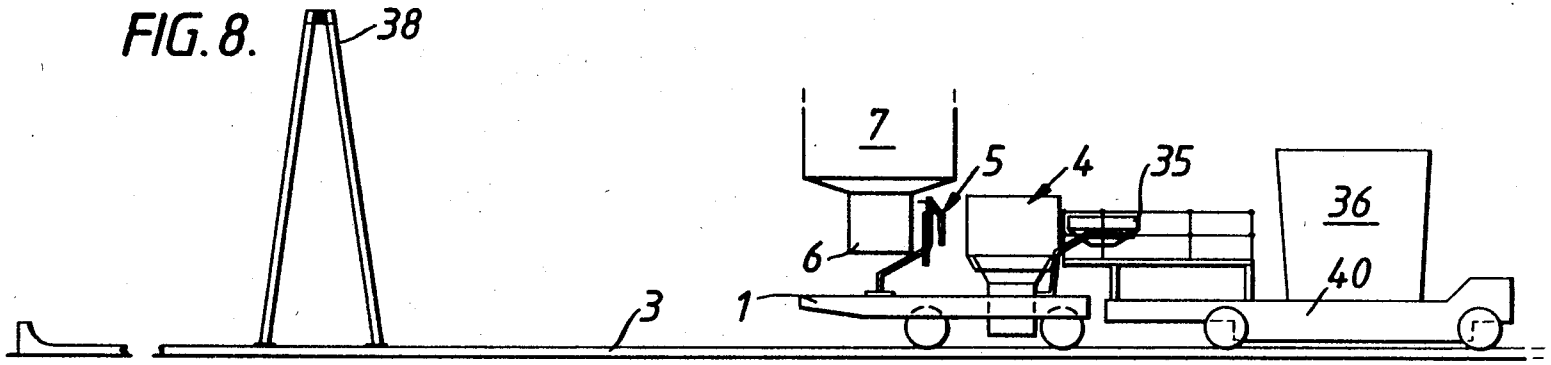

FIG. 8 shows the car 1 at the refractory spray position.

Figure 9:
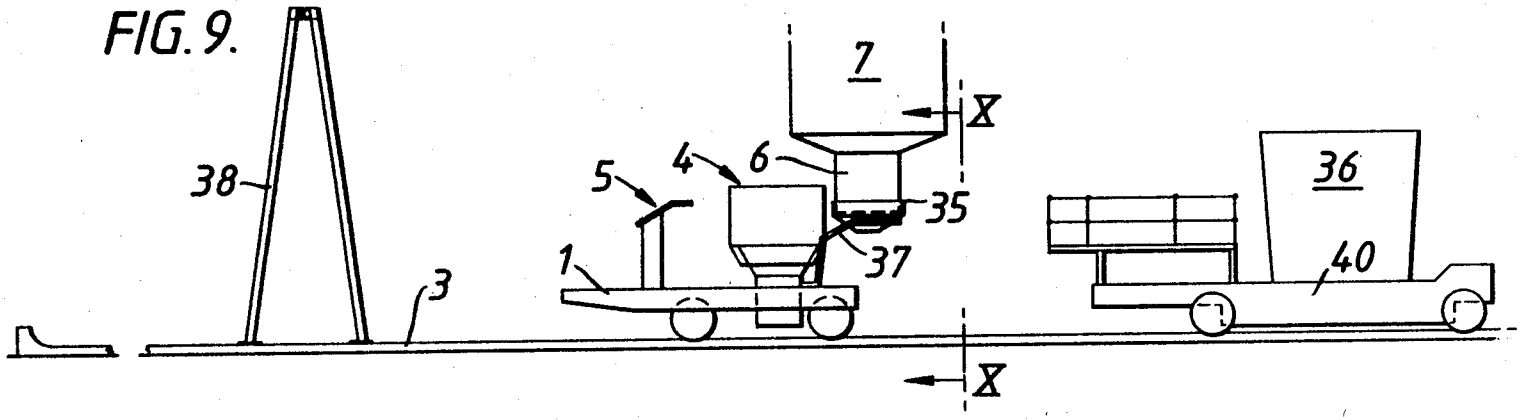
Figure 10:
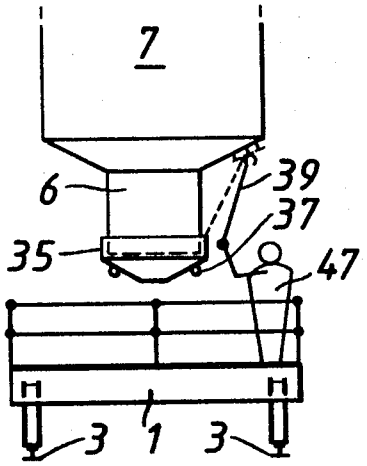

FIGS. 9 and 10 show the car 1 at the slag breaker mounting position, where the cone 35 is attached to the nozzle 6 by an operator 47 by means of wire ropes 39.

By means of the apparatus particularly described above we have enabled a vacuum degassing vessel nozzle to be deskulled and gunned efficiently after each operation in such a manner as to minimise the manual effort required and most significantly reduce the time required for the operation.

We claim:

1. Apparatus for cleaning or deskulling a downwardly protruding nozzle of a vacuum degassing vessel comprising a rotatable tool carrier capable of being positioned below the degassing vessel; said tool carrier being open topped and having a base and sides, and having side scraping tools fixed about the sides and bottom scraping tools fixed at the base; means for rotating the tool carrier; and means for lowering the vessel and/or raising the tool carrier whereby the nozzle enters the carrier so as to engage the sides of the nozzle with the side tools and then the bottom of the nozzle with the bottom tools.

2. Apparatus as claimed in claim 1 wherein the tools are multi-bladed.

3. Apparatus for cleaning or deskulling a downwardly protruding nozzle of a vacuum degassing vessel comprising a rotatable tool carrier capable of being positioned below the degassing vessel; said tool carrier being open topped and having a base and sides, and having side scraping tools fixed around the sides and bottom scraping tools fixed at the base; means for rotating the tool carrier; means for lowering the vessel and/or raising the tool carrier whereby the nozzle enters the carrier so as to engage the sides of the nozzle with the side tools and then the bottom of the nozzle with the bottom tools; and means for spraying refractory material on to parts of the degassing vessel.

4. Apparatus as claimed in claim 3 including a heat-protected refractory spray device arranged to be rotated about the nozzle to coat the external surface thereof with layers of refractory material.

5. Apparatus as claimed in claim 3 including a telescopic spray device carrying at its upper end a refractory spray nozzle which can be raised and lowered inside the degassing vessel nozzle to spray the inside surface thereof.

6. Apparatus as claimed in claim 3 wherein the tool carrier is disposed on a supporting car which is provided with wheels and runs on tracks extending below the degassing vessel.

7. Apparatus as claimed in claim 6 wherein the means for spraying refractory material is mounted on the supporting car with the tool carrier.

8. Apparatus as claimed in claim 7 wherein the tool carrier and the means for spraying are aligned across the supporting car for sequential operation with the degassing vessel nozzle.

9. Apparatus as claimed in claim 7 wherein the supporting car carries motors for the means for spraying and the tools, and refractory powder and water for the means for spraying.

* * * * *